US005193356A

United States Patent [19]

Ording et al.

[11] Patent Number: 5,193,356

[45] Date of Patent: Mar. 16, 1993

[54] HOUSEHOLD REFRIGERATOR ADJUSTABLE TEMPERATURE STORAGE SYSTEM

[75] Inventors: Thomas M. Ording; John M. Mitchell, both of Louisville, Ky.

[73] Assignee: General Electric Company, Louisville, Ky.

[21] Appl. No.: 756,431

[22] Filed: Sep. 9, 1991

[51] Int. Cl.[5] ..... F25D 23/02

[52] U.S. Cl. ..... 62/265; 62/408; 62/382

[58] Field of Search ..... 62/78, 265, 382, 408, 62/419, 441

[56] References Cited

U.S. PATENT DOCUMENTS

| | | | |
|---|---|---|---|
| 2,219,833 | 10/1940 | Atchison | 62/408 |
| 2,240,193 | 4/1941 | Newman | 62/408 |
| 3,364,694 | 12/1966 | Cohen et al. | 62/265 |
| 3,473,345 | 10/1969 | Pfeiffer et al. | 62/382 |
| 3,600,905 | 8/1971 | Dymek et al. | 62/382 |
| 3,638,717 | 8/1969 | Harbour et al. | 165/30 |
| 4,013,434 | 3/1977 | Kronenberger et al. | 62/382 |
| 4,241,589 | 8/1979 | Grimm et al. | 62/265 |
| 4,250,719 | 9/1979 | Grimm et al. | 62/382 |
| 4,288,995 | 9/1981 | Grimm et al. | 62/382 |

*Primary Examiner*—Albert J. Makay
*Assistant Examiner*—William C. Doerrler
*Attorney, Agent, or Firm*—Radford M. Reams; H. Neil Houser

[57] ABSTRACT

A refrigerator includes a fresh food compartment with a rear wall, an evaporator refrigerating air and an air passageway directing a stream of refrigerated air to flow down the rear wall. An adjustable storage assembly includes a frame mounted adjacent the rear wall, a storage pan slideably mounted to the frame, a shroud surrounding the pan and an air deflector extending upwardly and upwardly of the rear of the shroud. An user operable handle mounted to the frame and connected to the shroud for adjusting the position of the shroud and the deflector relative to the stream of air.

6 Claims, 3 Drawing Sheets

HOUSEHOLD REFRIGERATOR ADJUSTABLE TEMPERATURE STORAGE SYSTEM

BACKGROUND OF THE INVENTION

This invention relates to household refrigerators, and, more particularly, to combination refrigerators in which the freezer compartment is positioned above the fresh food compartment within the cabinet. Both compartments conventionally are cooled or refrigerated by circulating air from each of them over a single evaporator and returning the refrigerated air to the compartments. More particularly, this invention relates to a storage system mountable in the fresh food compartment and adjustable to control the flow of refrigerated air flowing around a storage pan to adjust the temperature inside the pan.

Normally such combination refrigerators circulate a major portion of the refrigerated air from the evaporator through the freezer and a lesser portion of the refrigerated air though the fresh food compartment. In addition, it is well known to direct a portion of the fresh food compartment refrigerated air downwardly through that compartment and around a storage pan to keep the interior of the pan at a slightly lower temperature than the main portion of the fresh food compartment. These pans are particularly useful for storing fresh foods such as fruits, vegetables and meats which benefit from storage at slightly lower temperatures than many other items. U.S. Pat. Nos. 4,241,589 and 4,288,995 illustrate two systems for adjusting the air flow around the pan to thereby adjust the temperature of the interior of the pan. Each of these patents is incorporated herein by reference. It is desirable to simplify the adjustable temperature assembly as much as possible, consistent with both sureness and ease of operation. By the present invention we provide an adjustable temperature assembly which is easy for the user to operate and is sure in its operation while being simple in design and including a minimum number of parts.

SUMMARY OF THE INVENTION

According to one form of the present invention, there is provided a refrigerator including a fresh food compartment with side and back walls and refrigerated air is directed downwardly over the back wall. An adjustable temperature storage assembly includes a frame mounted adjacent the back wall and a pan slidably mounted on the frame. A cover for the pan also is mounted on the frame to close the top of the pan when it is fully seated in the frame. A shroud is slidably mounted from the frame and includes side and bottom walls spaced from corresponding walls of the pan. An air deflector is formed integrally with the shroud bottom wall and angles upwardly from the rear thereof. An user operable handle is pivotally mounted to the frame and has an angled interconnection with the shroud so that movement of the handle by the user causes the shroud, and thus the air deflector's position, to change relative to the stream of refrigerated air flowing down the back wall of the fresh food compartment. This adjusts the amount of air flowing between the pan and shroud and thus adjusts the temperature of the inside of the pan relative to the remainder of the fresh food compartment.

DESCRIPTION OF THE PREFERRED EMBODIMENTS

Figure 1:
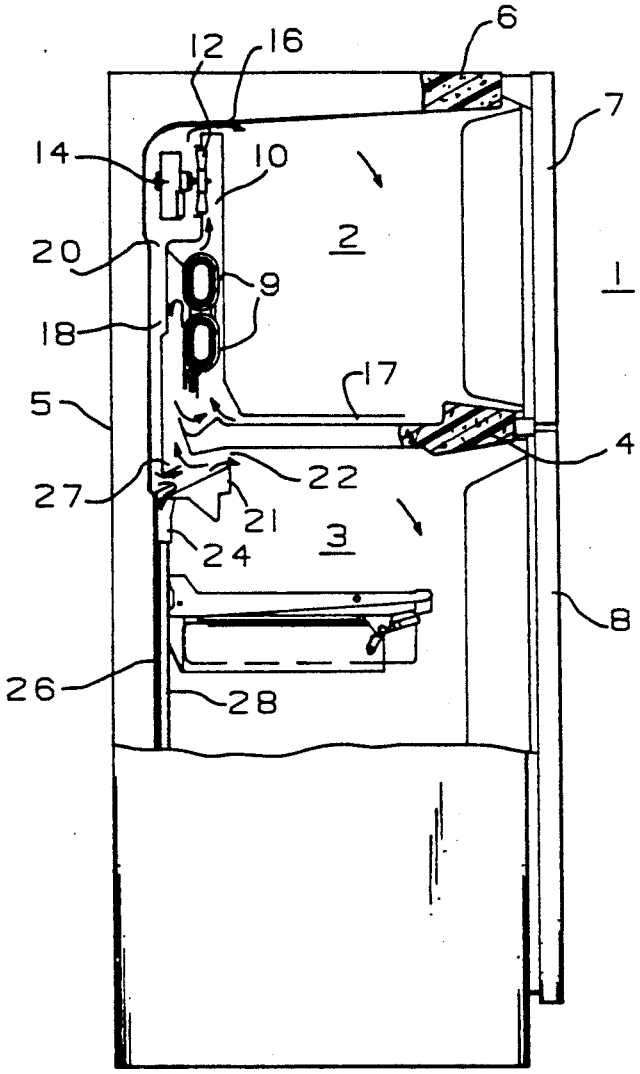
FIG. 1 is a simplified side elevational view, partly in section of a refrigerator having a freezer compartment on top and a fresh food compartment on the bottom and embodying one form of the present invention.

Referring particularly to FIG. 1, there is illustrated one embodiment of the present invention. A refrigerator 1 includes an upper freezer compartment 2 and a lower fresh food compartment 3 separated by an insulated partition 4. The compartments are separated from the outer shell or cabinet 5 by means of insulation 6. Conventionally, the insulation 6 is foamed in place material such polyurethane and the partition 4 conveniently is made of the same material. A hinged door 7 provides access to the freezer while a hinged door 8 provides access to the fresh food compartment.

Both compartments are maintained at appropriate temperatures by means of a single evaporator 9 which operates at below freezing temperatures, is positioned within the freezer compartment 2 and is separated from the food storage area of the freezer by a liner 10 for protection. A forced air system, including a fan 12 driven by a motor 14, circulates air between the evaporator 9 and both of the freezer 2 and fresh food compartment 3. Most of the refrigerated air from the evaporator 9 passes through an opening 16 into the food storage area of the freezer and then returns to the evaporator through a passage 17. An air duct 18 is formed adjacent the rear wall of the refrigerator and has an inlet opening 20 adjacent the fan 12 to receive a smaller portion of the refrigerated air. A baffle 21 divides the air flowing through duct 18 so that part of it exits through opening 22 into the upper end of the fresh food compartment 3, and the remainder of the air is channeled by duct extension 24 to flow down the rear or back wall 26 of the fresh food compartment. Air is returned from the fresh food compartment 3 to the evaporator 9 through a passage partly shown at 27.

In household refrigerators it is desirable to provide means so that the users can adjust the position of the various shelves and storage pans or drawers so that the interior configuration of the fresh food compartment can be altered to suit the preference of the user. One approach is to provide either two or three spaced apart, vertically extending, elongated support strips or tracks which are attached to the back wall of the fresh food compartment. Conveniently, the tracks include vertically spaced openings (not shown) which receive mounting hooks and tabs of shelf supports so that the supports can be positioned within the compartment where the user desires. Such systems are well known and will not be described in further detail.

As set forth in U.S. Pat. Nos. 4,241,589 and 4,288,995, for example, it is desirable to include in the fresh food compartment a pan or drawer assembly which is adjustable relative to the stream of refrigerated flowing down the back wall of the fresh food compartment so that the amount of that air which flows around the pan is adjusted. In this way, the temperature inside the pan can be adjusted. Referring now more particularly to FIG's 2-5, there is illustrated such a system which is simple in construction and sure in operation. A frame includes a pair of spaced apart elongated brackets 30 and 31 which have hooks 33 and tabs 34 at one end to removably mount the brackets to the tracks 28. In this way the frame can be positioned adjacent the back wall 26 at the location which best suits the user. The brackets 30 and 31 are held in a predetermined spaced apart configuration by cross members such as rod 35, as is well known. Elongated slides 36 and 37 are attached to the inner sides of the brackets 30 and 31, respectively. Conveniently, the brackets are formed from a suitable metal such as steel to provide strength and rigidity while the slides are formed from a suitable molded plastic resin. The slides 36 and 37 are formed with upper guideways 38 and 39 and with lower guideways 40 and 41, respectively. As will be explained in more detail hereafter, the guideways extend for at least most of the length of the brackets.

Figure 2:
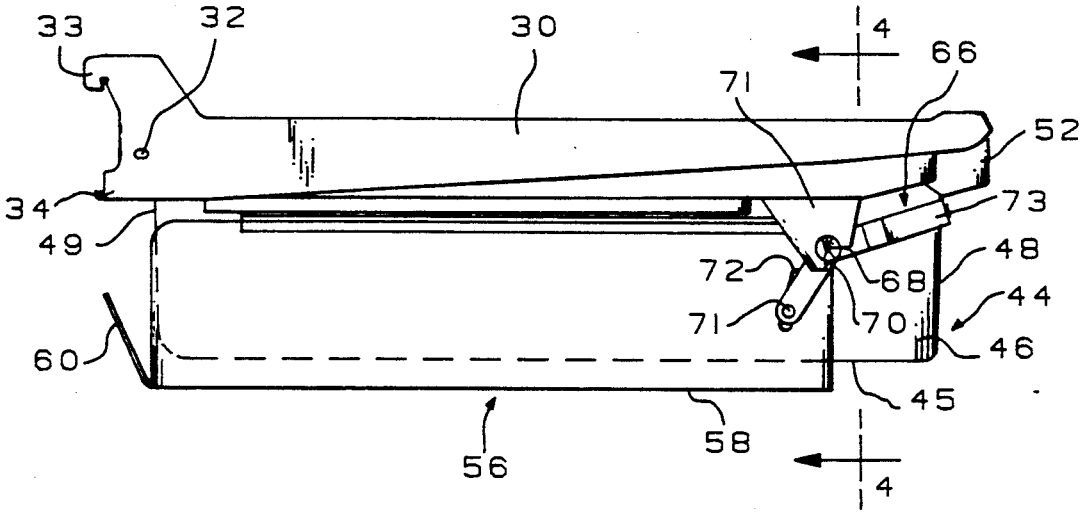
FIG. 2 is a side elevational view of the adjustable temperature storage assembly incorporated in the refrigerator of FIG. 1, illustrating the shroud in its position most removed from the stream of refrigerated air.
Figure 3:
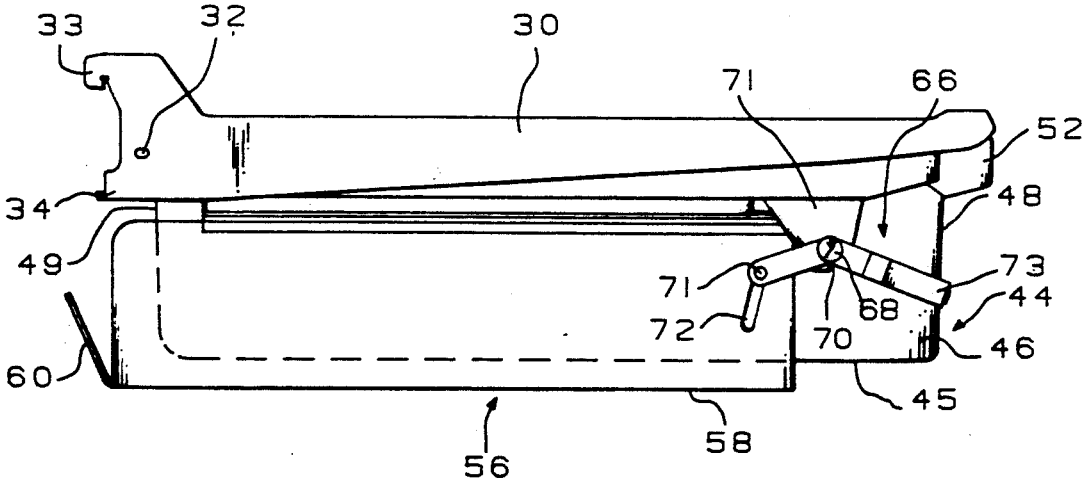
FIG. 3 is a side elevational view of the assembly of FIG. 2, but illustrating the shroud in its position furthermost inserted into the air stream.
Figure 4:
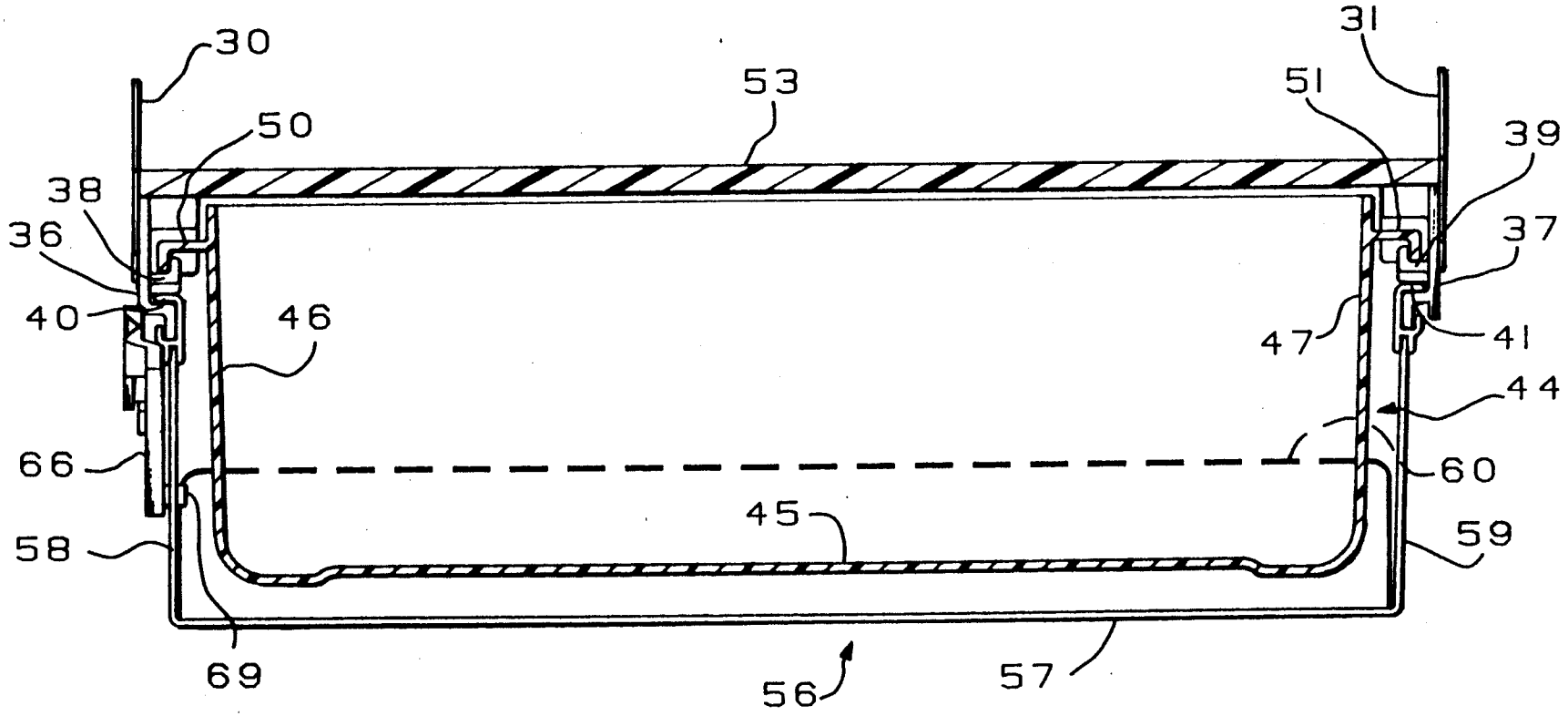
FIG. 4 is a cross-sectional view generally as seen along line 4—4 in FIG. 2.

An open top pan or drawer 44 includes a bottom wall 45, side walls 46 and 47, a front wall 48 and a rear wall 49. "L" shaped runners 50 and 51 are formed along the outer surfaces of the side walls 46 and 47, respectively. The runners 50 and 51 are received in the upper guideways 38 and 39, respectively, so that the user can slide the pan between a closed position, as shown in FIGS. 2 and 3, and an open position forward of the frame. To that end, the front wall 48 is formed with a handle or drawer pull 52. A sheet of glass or molded resin 53 rests on the brackets 30 and 31 just above the pan 44, when the pan is in its closed position. Thus, the sheet 53 serves as the cover for the pan 44 and provides a shelf for items positioned above the pan.

Figure 5:
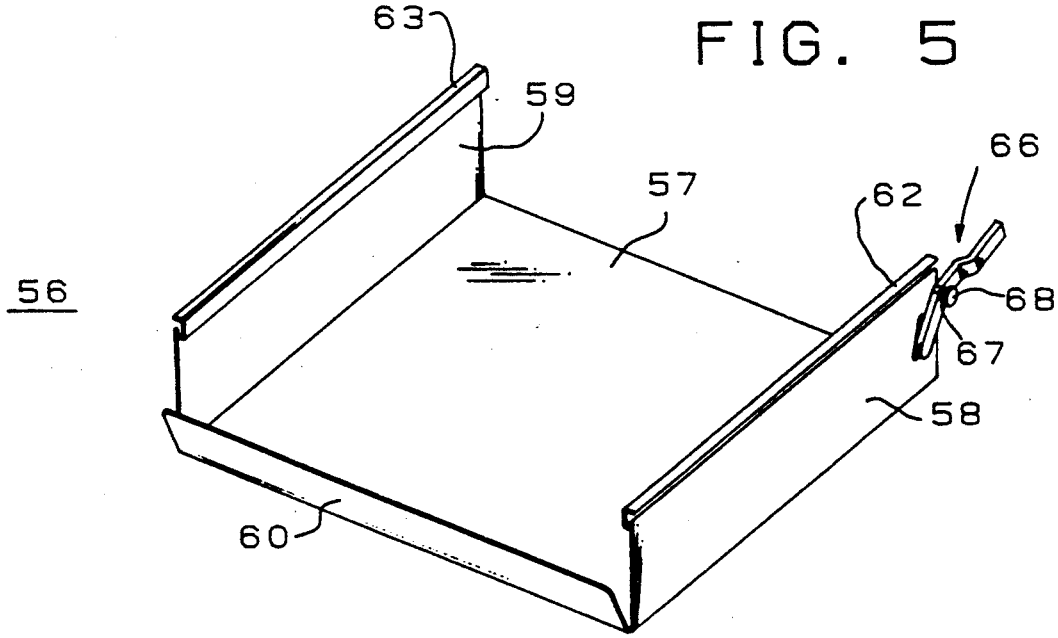
FIG. 5 is a top perspective view of the shroud incorporated in the adjustable temperature assembly illustrated in FIGS. 1–4.

Referring now particularly to FIG. 5, a shroud 56 includes a bottom wall 57, and side walls 58 and 59. An air deflector 60 is formed integrally with the bottom wall and extends upwardly and angles outwardly from the rear edge of the bottom wall. A pair of runners 62 and 63 are formed along the upper edges of the side walls 58 and 59, respectively, and are supported on the lower guideways 40 and 41 respectively of the slides 36 and 37. With this arrangement, the side and bottom walls of the shroud are generally parallel to and spaced from the corresponding bottom and side walls of the pan to guide at least a portion of the air flowing down the back wall of the fresh food compartment for flow around the pan 44. This flow of refrigerated air keeps the inside of the pan at lower temperatures than main portion of the fresh food compartment. The interface between the runners 62 and 63 with the guideways 40 and 41 enables the shroud to be moved between the position of FIG. 2 and the position of FIG. 3. In FIG. 2 the air deflector is positioned close to the back wall of the pan 44 and under the brackets 30 and 31. Thus, it is withdrawn to the maximum extent from interaction with the stream of refrigerated air flowing down the back wall 26 of the fresh food compartment. In this position, the deflector 60 diverts a minimum amount of the air to flow between the pan 44 and shroud 56. On the other hand, when the shroud 56 is in the position shown in FIG. 3, the air deflector is moved into the air stream to the greatest extent and it diverts the maximum amount of the refrigerated air to flow around the pan 44 within the shroud 56 to cool the inside of the pan to the greatest extent. It will be understood that the shroud can be positioned at intermediate points between those shown in FIGS. 2 and 3 to provide intermediate amounts of refrigerated air flow.

In order to provide a simple and effective means of user positioning of the shroud, a handle 66 is provided. Intermediate its ends, the handle is formed with a laterally projecting pin 67 having a head 68. At its inner distal end portion the handle is provided with a laterally extending projection or pin 69. The shroud is mounted from the brackets 30 and 31 with the pin 67 received in a short slot 70 formed in a downwardly extending projection 71 formed as part of bracket 30 and with the pin 71 received in a slot 72 formed in the side wall 58 of the shroud 56. The slot 72 is angled so that its upper end is closer to the front of the shroud and its lower end is closer to the back of the shroud. With this arrangement, an user can grasp the other distal end portion 73 of the handle and pivot the handle about the engagement of pin 67 in slot 70 between the position of FIG. 2 and that of FIG. 3. As the handle pivots, the engagement of pin 69 with slot 72 moves the shroud back and forth to adjust the amount of refrigerated air caused to flow around the pan 44.

The foregoing is a description of presently preferred embodiments of the invention. It should be understood that variations may be made therein without departing from the true spirit and scope of the invention.

What is claimed is:

1. In a refrigerator having a fresh food compartment with a rear wall, an evaporator for refrigerating air in the refrigerator and means for providing a stream of refrigerated air flowing generally down the rear wall of the fresh food compartment; an adjustable temperature storage assembly, comprising:

a frame mountable adjacent to the fresh food compartment rear wall;

a storage pan slidably mounted on said frame and a cover for said pan supported by said frame;

a shroud for said pan including a bottom wall and a pair of side walls spaced from corresponding walls of said pan, an air deflector extending upwardly and rearwardly from the rear of said shroud bottom wall in a fixed relationship thereto, said shroud being slidably mounted to said frame; and user adjustable positioning means operable to slide said shroud on said frame to alter the position of said air deflector in relation to the back wall of the fresh food compartment to vary the amount of refrigerated air flowing between said pan and said shroud.

2. The adjustable temperature storage assembly of claim 1, wherein said air deflector is formed integrally with said shroud.

3. The adjustable temperature storage assembly of claim 1, wherein said positioning means includes an user operable actuator movably mounted to said frame and connected to said shroud for sliding said shroud in response to user operation of said actuator.

4. The adjustable temperature storage assembly as set forth in claim 3, wherein said actuator is pivotally mounted to said frame and has an angled connection to said shroud.

5. A storage assembly as set forth in claim 1, wherein said positioning means includes a handle with one distal end portion arranged for user operation, the other distal portion provided with an angled pin and slot connection with said shroud and with an intermediate portion pivotally connected to said frame.

6. A storage assembly as set forth in claim 5, wherein said other distal portion of said handle includes a lateral projection and said shroud includes an angled slot receiving said lateral projection.

* * * * *